US006135830A

United States Patent [19]

Elefant et al.

[11] Patent Number: 6,135,830

[45] Date of Patent: Oct. 24, 2000

[54] FLOATATION DEVICE SYSTEM

[76] Inventors: Reuben Elefant; Elyezer Hus; Raphael Hamou, all of 7400 W. Oakland Park Blvd., Lauderhill, Fla. 33319

[21] Appl. No.: 09/267,010

[22] Filed: Mar. 11, 1999

[51] Int. Cl.[7] ..... B63H 21/175

[52] U.S. Cl. ..... 440/12; 440/12

[58] Field of Search ..... 114/61.1, 39.21; 440/12, 11, 21, 26, 27, 28, 29, 30, 31

[56] References Cited

U.S. PATENT DOCUMENTS

| | | | |
|---|---|---|---|
| 577,269 | 2/1897 | Powley | 440/12 |
| 1,761,883 | 6/1930 | Froedtert | 440/30 |
| 2,304,430 | 12/1942 | Triolo | 440/12 |
| 4,891,024 | 1/1990 | Benjamin | 440/28 |
| 5,387,140 | 2/1995 | Cunningham | 440/12 |

*Primary Examiner*—Stephen Avila

[57] ABSTRACT

A floatation device system for travelling across a body of water. The floatation device system includes a spaced apart pair of pontoons with spaced apart elongate front and back crossbeams extending therebetween. A forwards end of an elongate center beam is coupled to front crossbeam, the center beam is coupled to the back crossbeam. A rearwards end of the center beam is rearwardly extended from the back crossbeam. A rear rudder is pivotally coupled to the rearwards end of the center beam. A rotatable propeller is mounted to the rear rudder. A rotatable driven wheel is connected to the propeller by a flexible sheathed cable so that driven wheel rotates the cable which in turn rotates the propeller.

18 Claims, 6 Drawing Sheets

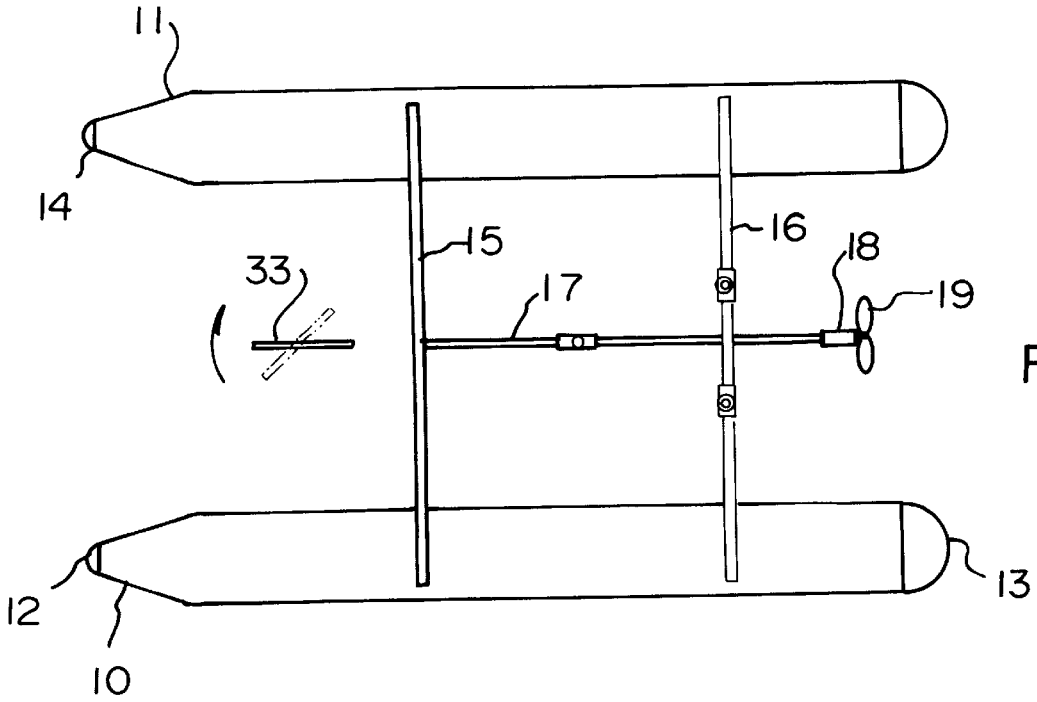
FIG. 3
FIG. 4
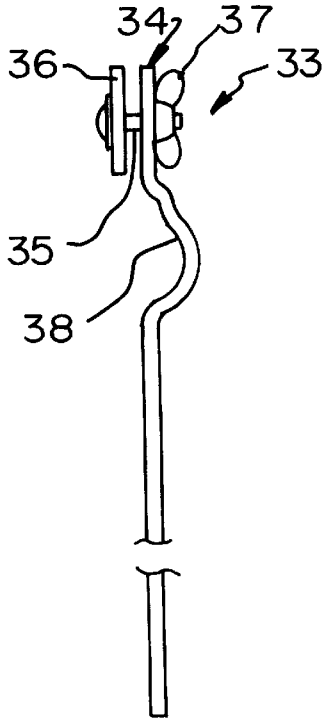
FIG. 5
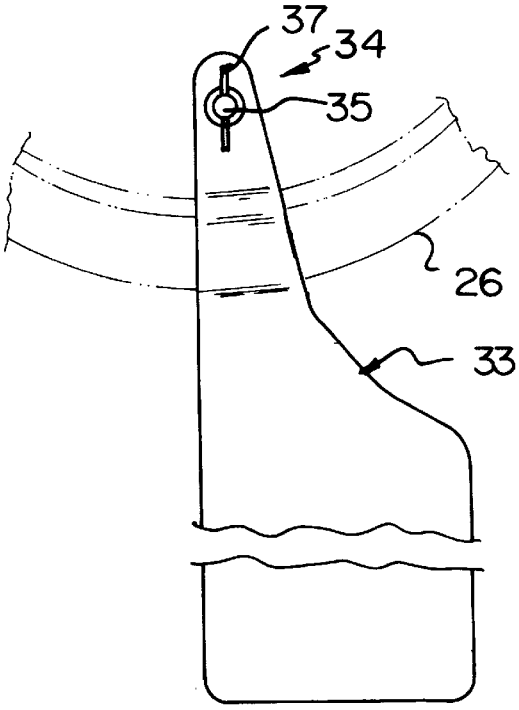

FIG. 12
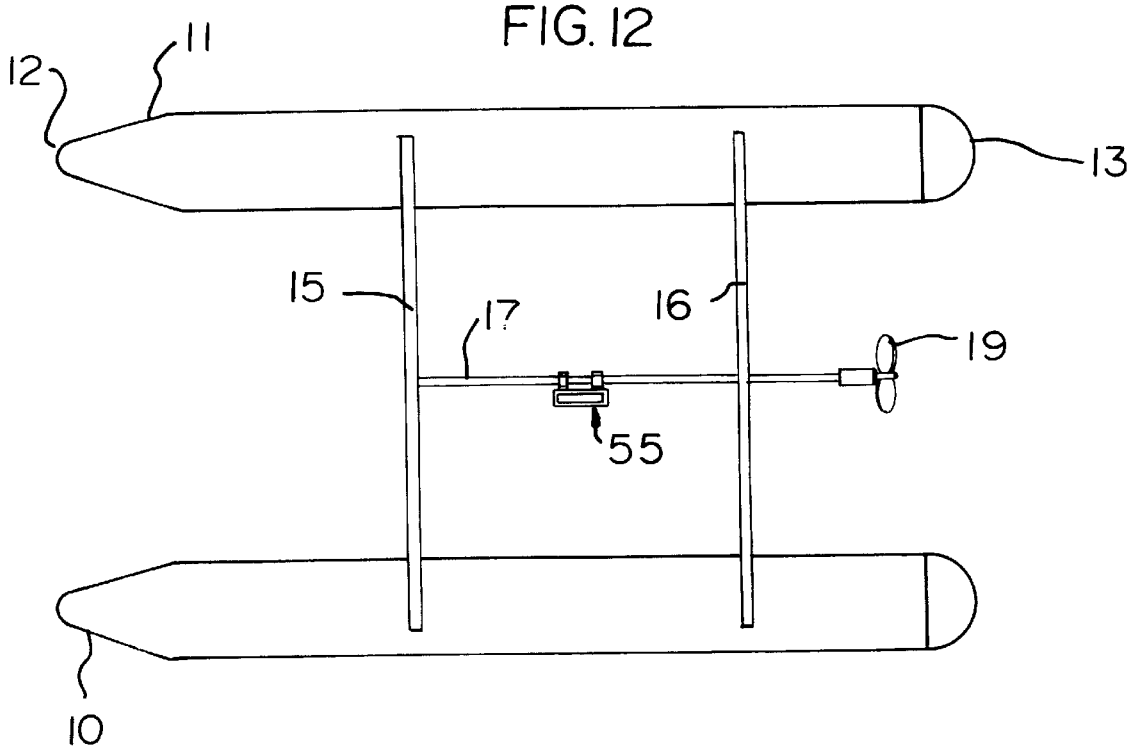
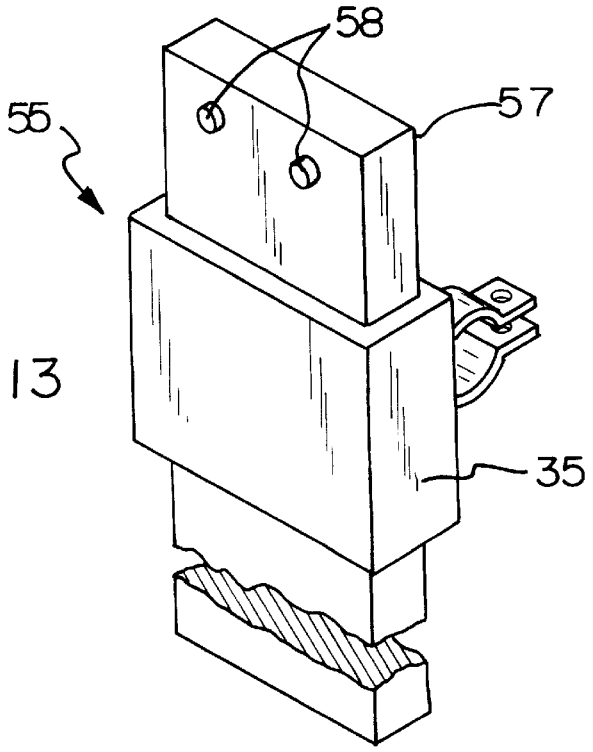
FIG. 13

FLOATATION DEVICE SYSTEM

BACKGROUND OF THE INVENTION

1. Field of the Invention

The present invention relates to floatation devices and more particularly pertains to a new floatation device system for travelling across a body of water.

2. Description of the Prior Art

The use of floatation devices is known in the prior art. More specifically, floatation devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,547,406 by White; U.S. Pat. No. 5,415,574 by Siviero; U.S. Pat. No. 5,226,843 by Yun; U.S. Pat. No. 3,640,239 by Petroskey; U.S. Pat. No. 2,757,631 by Truter; and U.S. Pat. No. 2,304,430 by Triolo.

While these devices fulfill their respective, particular objectives and requirements, the aforementioned patents do not disclose a new floatation device system. The inventive device includes a spaced apart pair of pontoons with spaced apart elongate front and back crossbeams extending therebetween. A forwards end of an elongate center beam is coupled to front crossbeam, the center beam is coupled to the back crossbeam. A rearwards end of the center beam is rearwardly extended from the back crossbeam. A rear rudder is pivotally coupled to the rearwards end of the center beam. A rotatable propeller is mounted to the rear rudder. A rotatable driven wheel is connected to the propeller by a flexible sheathed cable so that driven wheel rotates the cable which in turn rotates the propeller.

In these respects, the floatation device system according to the present invention substantially departs from the conventional concepts and designs of the prior art, and in so doing provides an apparatus primarily developed for the purpose of travelling across a body of water.

SUMMARY OF THE INVENTION

In view of the foregoing disadvantages inherent in the known types of floatation devices now present in the prior art, the present invention provides a new floatation device system construction wherein the same can be utilized for travelling across a body of water.

The general purpose of the present invention, which will be described subsequently in greater detail, is to provide a new floatation device system apparatus and method which has many of the advantages of the floatation devices mentioned heretofore and many novel features that result in a new floatation device system which is not anticipated, rendered obvious, suggested, or even implied by any of the prior art floatation devices, either alone or in any combination thereof.

To attain this, the present invention generally comprises a spaced apart pair of pontoons with spaced apart elongate front and back crossbeams extending therebetween. A forwards end of an elongate center beam is coupled to front crossbeam, the center beam is coupled to the back crossbeam. A rearwards end of the center beam is rearwardly extended from the back crossbeam. A rear rudder is pivotally coupled to the rearwards end of the center beam. A rotatable propeller is mounted to the rear rudder. A rotatable driven wheel is connected to the propeller by a flexible sheathed cable so that driven wheel rotates the cable which in turn rotates the propeller.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new floatation device system apparatus and method which has many of the advantages of the floatation devices mentioned heretofore and many novel features that result in a new floatation device system which is not anticipated, rendered obvious, suggested, or even implied by any of the prior art floatation devices, either alone or in any combination thereof.

It is another object of the present invention to provide a new floatation device system which may be easily and efficiently manufactured and marketed.

It is a further object of the present invention to provide a new floatation device system which is of a durable and reliable construction.

An even further object of the present invention is to provide a new floatation device system which is susceptible of a low cost of manufacture with regard to both materials and labor, and which accordingly is then susceptible of low prices of sale to the consuming public, thereby making such floatation device system economically available to the buying public.

Still yet another object of the present invention is to provide a new floatation device system which provides in the apparatuses and methods of the prior art some of the advantages thereof, while simultaneously overcoming some of the disadvantages normally associated therewith.

Still another object of the present invention is to provide a new floatation device system for travelling across a body of water.

Yet another object of the present invention is to provide a new floatation device system which includes a spaced apart pair of pontoons with spaced apart elongate front and back crossbeams extending therebetween. A forwards end of an elongate center beam is coupled to front crossbeam, the center beam is coupled to the back crossbeam. A rearwards end of the center beam is rearwardly extended from the back crossbeam. A rear rudder is pivotally coupled to the rearwards end of the center beam. A rotatable propeller is mounted to the rear rudder. A rotatable driven wheel is connected to the propeller by a flexible sheathed cable so that driven wheel rotates the cable which in turn rotates the propeller.

Still yet another object of the present invention is to provide a new floatation device system that may have a bicycle mounted thereto as part of the propulsion system.

Even still another object of the present invention is to provide a new floatation device system that has several detachable components that let a user vary the type of propulsion system used to propel the flotation device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic top view of the first embodiment of the present invention.

FIG. 4 is a schematic side view of the front rudder of the present invention.

FIG. 5 is another schematic side view of the front rudder of the present invention.

FIG. 12 is a schematic side view of a third embodiment of the present invention.

FIG. 13 is a schematic enlarged side view of an illustrative pivot coupling between the elongate portions of the guide handle of the third embodiment of the present invention.

DESCRIPTION OF THE PREFERRED EMBODIMENT

Figure 1:
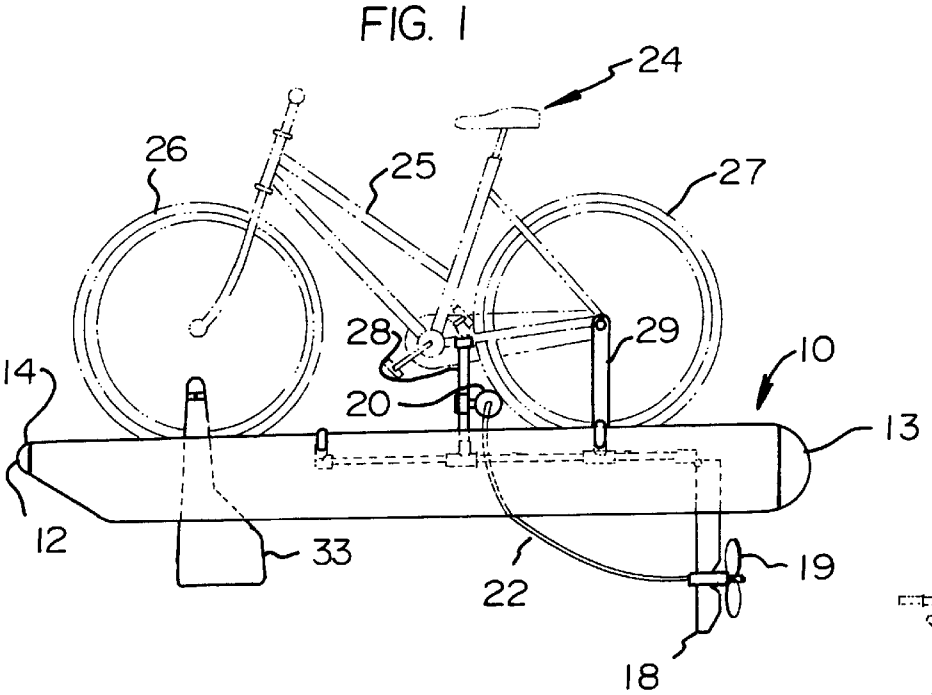
FIG. 1 is a schematic side view of a first embodiment of a new floatation device system according to the present invention.
Figure 2:
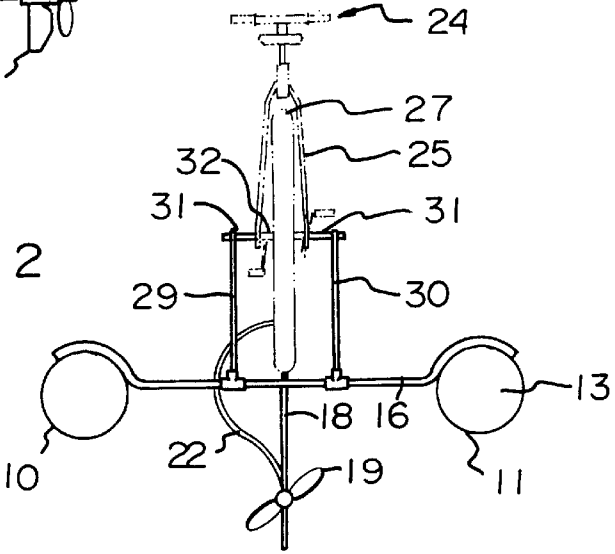
FIG. 2 is a schematic rear view of the first embodiment of the present invention.

With reference now to the drawings, and in particular to FIGS. 1 through 13 thereof, a new floatation device system embodying the principles and concepts of the present invention will be described.

As best illustrated in FIGS. 1 through 13, the floatation device system generally comprises a spaced apart pair of pontoons with spaced apart elongate front and back crossbeams extending therebetween. A forwards end of an elongate center beam is coupled to front crossbeam, the center beam is coupled to the back crossbeam. A rearwards end of the center beam is rearwardly extended from the back crossbeam. A rear rudder is pivotally coupled to the rearwards end of the center beam. A rotatable propeller is mounted to the rear rudder. A rotatable driven wheel is connected to the propeller by a flexible sheathed cable so that driven wheel rotates the cable which in turn rotates the propeller.

In closer detail, the floatation device system, comprises a spaced apart pair of generally cylindrical elongate hollow pontoons 10,11 designed for floating on a body of water. Each of the pontoons has opposite front and back ends 12,13, and a longitudinal axis extending between the front and back ends of the respective pontoon. The longitudinal axes of the pontoons are extended substantially parallel to one another. Each of the pontoons has a tapered region adjacent the front end of the respective pontoon tapering in a direction towards the front end of the respective pontoon. Preferably, each of the pontoons has a resiliently deformable bumper 14 at the front end of the respective pontoon. The back ends of the pontoons are ideally rounded to have a generally hemispherical shape.

Spaced apart elongate front and back crossbeams 15,16 are extended between the pontoons. The front crossbeam is positioned towards the front ends of the pontoons and the back crossbeam is positioned towards the back ends of the pontoons. The crossbeams each have a pair of ends and a longitudinal axis extending between the ends of the respective crossbeam. One end of each of the crossbeams is coupled to one of the pontoons and the other end of each of the cross beams is coupled to the other of the pontoons. The longitudinal axes of the cross beams are preferably extended substantially parallel to one another and substantially perpendicular to the longitudinal axes of the pontoons.

An elongate center beam 17 is provided having opposite forwards and rearwards ends and a longitudinal axis is extended between the forwards and rearwards ends of the center beam. The forwards end of the center beam is coupled to front crossbeam and the center beam is also coupled to the back crossbeam. The rearwards end of the center beam is rearwardly extended from the back crossbeam so that the rearwards end of the center beam is positioned between the back crossbeam and the back ends of the pontoons. Preferably, the longitudinal axis of the center beam is extended substantially perpendicular to the longitudinal axes of the crossbeams and substantially parallel to the longitudinal axes of the pontoons. Ideally, the center beam is generally equidistantly positioned between the pontoons.

The upper end of a rear rudder 18 is pivotally coupled to the rearwards end of the center beam. The rear rudder is pivotable about an substantially horizontal axis between a raised position and a lower position. The lower end of the rear rudder is outwardly extended from the rearwards end of the center beam towards the back ends of the pontoons when the rear rudder is positioned in the raised position. As best illustrated in FIG. 1, the lower end of the rear rudder is downwardly extended from the rearwards end of the center beam when the rear rudder is positioned in the raised position, the lower end of the rear rudder is positioned below the pontoons when the rear rudder is positioned in the lower position.

Figure 6:
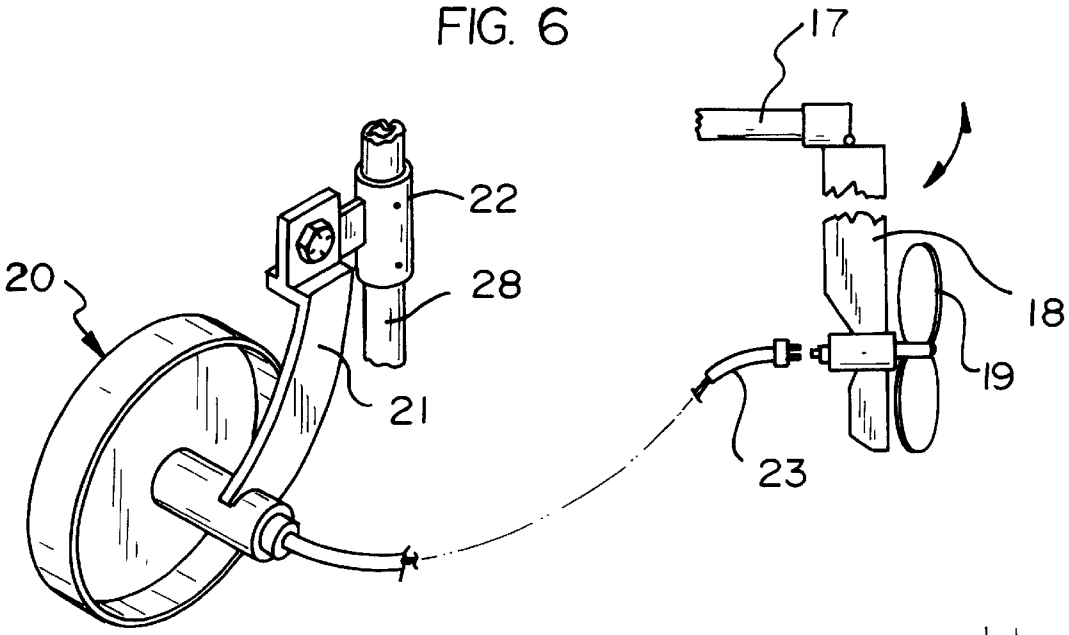
FIG. 6 is a schematic perspective view of the drive system of the present invention.

A rotatable propeller 19 is mounted to the rear rudder. As best illustrated in FIG. 6, a rotatable driven wheel 20 is providedwith a mounting arm 21 having a clamping sleeve 22 pivotally coupled thereto. An elongate flexible sheathed cable 23 connects the driven wheel to the propeller. In use, the driven wheel rotates the cable in the sheath of the cable when the driven wheel is rotated. In turn, the cable rotates the propeller when the cable is rotated by the driven wheel.

With reference to FIGS., 1 through 7, in a first preferred embodiment of the floatation device system a bicycle 24 is mounted to and positioned above the back crossbeam and the center beam. The bicycle has a frame 25, front and rear wheels 26,27, and a drive chain system for rotating the rear wheel of the bicycle. The front wheel of the bicycle is positioned between the front beam and the front ends of the pontoons and the rear wheel of the bicycle is positioned adjacent the rear cross beam.

In this embodiment, an upwardly extending front mounting bar 28 is detachably attached to the center beam between the front and back crossbeams. The front mounting bar is preferably extended substantially perpendicular and substantially vertical to longitudinal axis the center beam. The front mounting bar has a top end detachably attached to the frame of the bicycle adjacent the front chain ring of the bicycle.

Figure 7:
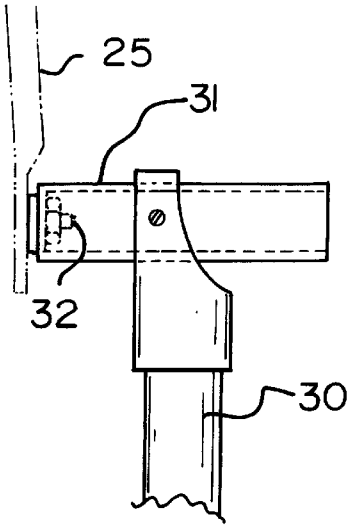
FIG. 7 is a schematic side view of a mounting tube of the first embodiment of the present invention.

Also included in this embodiment, are a spaced apart pair of upwardly extending rear mounting bars 29,30 detachably attached to the back crossbeam with the center beam positioned between the rear mounting bars. The rear mounting bars each have a top end detachably attached to the frame of the bicycle adjacent the rear wheel axle of the bicycle. Preferably, as best illustrated in FIG. 7, the top end of each of the rear mounting bars has an open ended mounting tube 31 pivotally coupled thereto to permit extension of the respective mounting tube substantially perpendicular to the longitudinal axis of the respective rear mounting bar. Each end of the rear axle 32 of the bicycle is inserted to the mounting tube of the adjacent rear mounting bar to detachably attach the rear wheel to the rear mounting bars.

As shown in FIG. 1, the clamping sleeve of the mounting arm of the driven gear is detachably attached to the front mounting bar. The mounting arm of the driven gear is pivoted to a position where the driven gear engaging with the rear wheel (by is contact therewith) such that rotation of the rear wheel rotates the driven gear. In use, a rider sits on the bicycle and pedals to rotate the rear wheel. In turn, the rear wheel rotates the driven wheel which causes the propeller to rotate via the cable to propel the floatation device through the water.

Preferably, a front rudder 33 is detachably attached to the spokes of the front wheel of the bicycle and downwardly depended from the front wheel of the bicycle. The front rudder has upper and lower ends. The upper end of the front rudder has a clamp 33 detachably attaching the front rudder to the front wheel of the bicycle. The lower end of the front rudder is downwardly extended below the pontoons. With reference to FIG. 4, the clamp ideally comprises a threaded bolt 35 extending through the front rudder with a plate 36 at one end and a wing nut 37 threaded thereon so that the front wheel may be held between the plate of the clamp and the front rudder. The front rudder also preferably has a generally U-shaped lateral groove 38 adjacent the upper end of the rudder, a portion of the tire of the front wheel of the bicycle is extended into the lateral groove of the front rudder. In use, the front rudder is designed for steering the flotation device by the user sitting on the bicycle when the user turns the front wheel of the bicycle with the bicycle's handlebars.

Figure 10A:
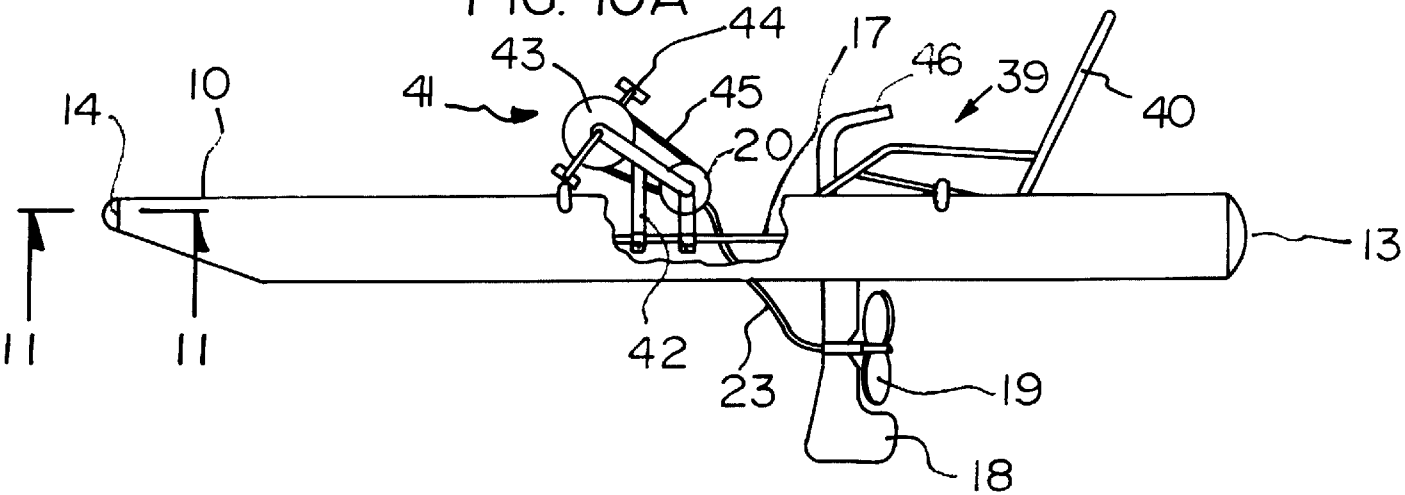
FIG. 10A is a schematic side view of a second embodiment of the present invention.
Figure 11:
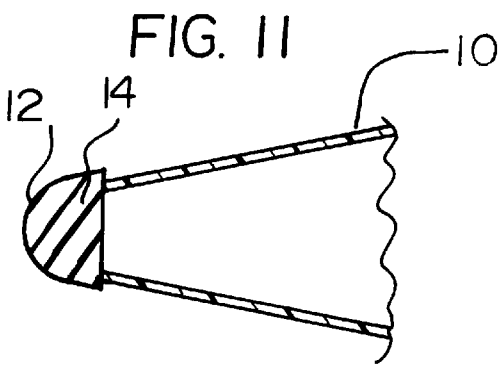
FIG. 11 is a schematic cross-sectional view of a pontoon taken from line 11—11 of FIG. 10A.
Figure 10B:
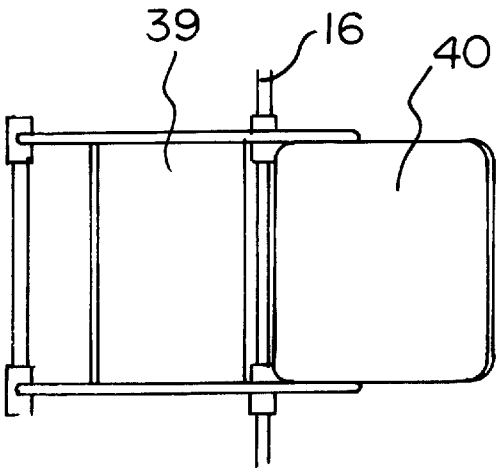
FIG. 10B is a schematic top view of the seat of the second embodiment of the present invention.

FIGS. 10A and 10B illustrate another preferred embodiment of the invention. In this embodiment, a seat 39 with an upwardly extending backrest 40 is detachably attached to the back crossbeam and to the center beam. In this embodiment, a drive assembly 41 is detachably attached to the center beam between the front and back crossbeams. The drive assembly has a post 42 detachably attached to the front crossbeam. A first end of the post has a toothed drive wheel 43 rotatably mounted thereto with a pair of foot pedals 44 extending therefrom. A second end of the post has a toothed version of the rotatable driven wheel detachably attached thereto. The drive assembly has an endless loop chain or belt 45 looped around the drive wheel and the driven wheel such that rotation of the drive wheel with the pedals by the feet of a user sitting in the seat in turn rotates the driven wheel. Additionally, the rear rudder in this embodiment has a forwardly extending tiller 46 detachably coupled thereto.

With reference to FIGS. 8, 9, 12, and 13, in another embodiment of the invention, an substantially vertically upwardly extending elongate mast 47 is detachably and swivelably attached to the center beam between the front and back crossbeams. An umbrella sail 48 is forwardly extended from an upper end of the mast. The umbrella sail has an elongate shaft 49 coupled at a first end of the shaft to the upper end of the mast and a canopy 50 with a ribbed frame coupled to a second end of the shaft opposite the first end of the shaft. Preferably, the shaft of the umbrella sail is extended generally horizontally.

Figure 8:
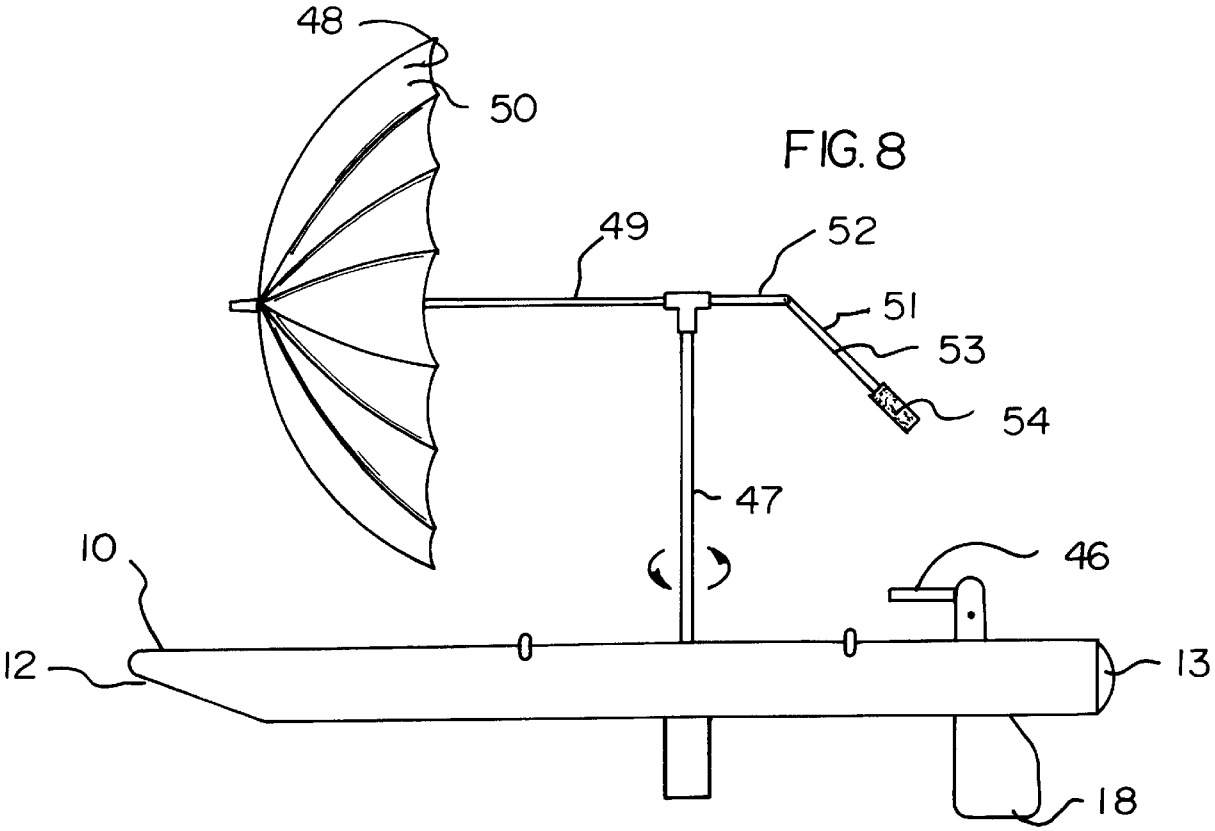
FIG. 8 is a schematic top view of the present invention with the keel coupled thereto.
Figure 9:
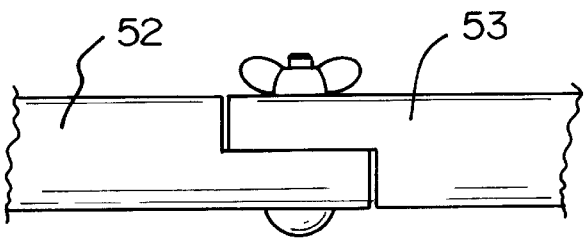
FIG. 9 is a schematic perspective view of the keel of the present invention.

Preferably, a guide handle 51 is rearwardly extended from the upper end of the mast. As illustrated in FIGS. 8 and 9, the guide handle has a pair of elongate portions 52,53 pivotally coupled together. A first of the elongate portions of the guide handle is positioned adjacent the upper end of the mast and is extended substantially parallel to the shaft of the umbrella sail. The second of the elongate portions of the guide handle terminates at a resiliently deformable handgrip 54.

Also provided in this embodiment, is a keel 55 detachably attached to the center beam. As illustrated in FIG. 13, the keel comprises a mounting bracket 56 detachably attaching the keel to the center beam and an elongate center board 57 slidably extended through the mounting bracket and downwardly depending from the center beam. The center board has a pair of stops 58 at an upper end to prevent sliding of the center board completely through the mounting bracket of the keel.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A floatation device system, comprising:

a spaced apart pair of pontoons having opposite front and back ends, and a longitudinal axis extending between said front and back ends of the respective pontoon;

spaced apart elongate front and back crossbeams being extended between said pontoons, said crossbeams each having a pair of ends and a longitudinal axis extending between said ends of the respective crossbeam;

said front crossbeam being positioned towards said front ends of said pontoons, said back crossbeam being positioned towards said back ends of said pontoons;

an elongate center beam having opposite forwards and rearwards ends and a longitudinal axis being extended between said forwards and rearwards ends of said center beam;

said forwards end of said center beam being coupled to front crossbeam, said center beam being coupled to said back crossbeam;

said rearwards end of said center beam being rearwardly extended from said back crossbeam, said rearwards end of said center beam being positioned between said back crossbeam and said back ends of said pontoons;

a rear rudder having upper and lower ends, said upper end of said rear rudder being pivotally coupled to said rearwards end of said center beam;

a rotatable propeller being mounted to said rear rudder;

a rotatable driven wheel;

an elongate flexible sheathed cable connecting said driven wheel to said propeller, said driven wheel rotating said cable when said driven wheel is rotated, said cable rotating said propeller when said cable is rotated;

a bicycle being mounted to and positioned above said back crossbeam and said center beam, said bicycle having a frame, front and rear wheels, and a drive chain system for rotating said rear wheel of said bicycle, said driven gear engaging with said rear wheel such that rotation of said rear wheel rotates said driven gear; and an upwardly extending front mounting bar being detachably attached to said center beam between said front and back crossbeams, said front mounting bar having a top end detachably attached to said frame of said bicycle.

2. The floatation device system of claim 1, further comprising a spaced apart pair of upwardly extending rear mounting bars being detachably attached to said back crossbeam, said center beam being positioned between said rear mounting bars, said rear mounting bars each having a top end detachably attached to said frame of said bicycle.

3. The floatation device system of claim 1, further comprising front rudder being detachably attached to said front wheel of said bicycle and downwardly depended from said front wheel of said bicycle.

4. The floatation device system of claim 3, wherein said front rudder has upper and lower ends, said upper end of said front rudder having a clamp detachably attaching said front rudder to said front wheel of said bicycle, wherein said front rudder has a generally U-shaped lateral groove adjacent said upper end of said rudder, a portion of said front wheel of said bicycle being extended into said lateral groove of said front rudder.

5. The floatation device system of claim 1, further comprising a seat being detachably attached to said back crossbeam and to said center beam, said seat having an upwardly extending backrest.

6. The floatation device system of claim 5, further comprising a drive assembly being detachably attached to said center beam between said front and back crossbeams, said drive assembly having a post detachably attached to said front crossbeam, a first end of said post having a drive wheel rotatably mounted thereto, said drive wheel having a pair of foot pedals extending therefrom, a second end of said post having said rotatable driven wheel detachably attached thereto, said drive assembly having an endless loop looped around said drive wheel and said driven wheel.

7. The floatation device system of claim 5, wherein said rear rudder has a forwardly extending tiller detachably coupled thereto.

8. The floatation device system of claim 1, further comprising an upwardly extending elongate mast being detachably and swivelably attached to said center beam between said front and back crossbeams, an umbrella sail being forwardly extended from an upper end of said mast, said umbrella sail having an elongate shaft coupled at a first end of said shaft to said upper end of said mast and a canopy coupled to a second end of said shaft opposite said first end of said shaft.

9. The floatation device system of claim 8, wherein said shaft of said umbrella sail is extended generally horizontally.

10. The floatation device system of claim 8, further comprising a guide handle being rearwardly extended from said upper end of said mast, said guide handle having a pair of elongate portions pivotally coupled together, a first of said elongate portions of said guide handle being positioned adjacent said upper end of said mast and being extended substantially parallel to said shaft of said umbrella sail, a second of said elongate portions of said guide handle terminating at a handgrip.

11. The floatation device system of claim 8, further comprising a keel being detachably attached to said center beam, said keel comprising a mounting bracket detachably attaching said keel to said center beam and an elongate center board slidably extended through said mounting bracket and downwardly depending from said center beam.

12. A floatation device system, comprising:

a spaced apart pair of generally cylindrical elongate pontoons, each having opposite front and back ends, and a longitudinal axis extending between said front and back ends of the respective pontoon;

said longitudinal axes of said pontoons being extended substantially parallel to one another;

each of said pontoons having a tapered region adjacent said front end of the respective pontoon tapering in a direction towards said front end of the respective pontoon;

each of said pontoons having a resiliently deformable bumper at said front end of the respective pontoon;

said back ends of said pontoons being rounded to have a generally hemispherical shape;

spaced apart elongate front and back crossbeams being extended between said pontoons, said crossbeams each having a pair of ends and a longitudinal axis extending between said ends of the respective crossbeam;

said front crossbeam being positioned towards said front ends of said pontoons, said back crossbeam being positioned towards said back ends of said pontoons;

one end of each of said crossbeams being coupled to one of said pontoons, the other end of each of said cross beams being coupled to the other of said pontoons;

said longitudinal axes of said cross beams being extended substantially parallel to one another and substantially perpendicular to said longitudinal axes of said pontoons;

an elongate center beam having opposite forwards and rearwards ends and a longitudinal axis being extended between said forwards and rearwards ends of said center beam;

said forwards end of said center beam being coupled to front crossbeam, said center beam being coupled to said back crossbeam;

said rearwards end of said center beam being rearwardly extended from said back crossbeam, said rearwards end of said center beam being positioned between said back crossbeam and said back ends of said pontoons;

said longitudinal axis of said center beam being extended substantially perpendicular to said longitudinal axes of said crossbeams, said longitudinal axis of said center beam being extended substantially parallel to said longitudinal axes of said pontoons;

said center beam being generally equidistantly positioned between said pontoons;

a rear rudder having upper and lower ends, said upper end of said rear rudder being pivotally coupled to said rearwards end of said center beam;

said rear rudder being pivotable about an substantially horizontal axis between a raised position and a lower position;

said lower end of said rear rudder being outwardly extended from said rearwards end of said center beam towards said back ends of said pontoons when said rear rudder is positioned in said raised position;

said lower end of said rear rudder being downwardly extended from said rearwards end of said center beam when said rear rudder is positioned in said raised position, said lower end of said rear rudder being positioned below said pontoons when said rear rudder is positioned in said lower position;

a rotatable propeller being mounted to said rear rudder;

a rotatable driven wheel having a mounting arm;

an elongate flexible sheathed cable connecting said driven wheel to said propeller, said driven wheel rotating said cable when said driven wheel is rotated, said cable rotating said propeller when said cable is rotated;

a bicycle being mounted to and positioned above said back crossbeam and said center beam, said bicycle having a frame, front and rear wheels, and a drive chain system for rotating said rear wheel of said bicycle;

an upwardly extending front mounting bar being detachably attached to said center beam between said front and back crossbeams, said front mounting bar being extended substantially perpendicular to longitudinal axis said center beam;

said front mounting bar having a top end detachably attached to said frame of said bicycle;

a spaced apart pair of upwardly extending rear mounting bars being detachably attached to said back crossbeam, said center beam being positioned between said rear mounting bars;

said rear mounting bars each having a top end detachably attached to said frame of said bicycle;

said front wheel of said bicycle being positioned between said front beam and said front ends of said pontoons;

said rear wheel of said bicycle being positioned adjacent said rear cross beam;

said mounting arm of said driven gear being detachably attached to said front mounting bar said driven gear engaging with said rear wheel such that rotation of said rear wheel rotates said driven gear;

a front rudder being detachably attached to said front wheel of said bicycle and downwardly depended from said front wheel of said bicycle;

said front rudder having upper and lower ends, said upper end of said front rudder having a clamp detachably attaching said front rudder to said front wheel of said bicycle;

said front rudder having a generally U-shaped lateral groove adjacent said upper end of said rudder, a portion of said front wheel of said bicycle being extended into said lateral groove of said front rudder;

said lower end of said front rudder being downwardly extended below said pontoons;

a seat being detachably attached to said back crossbeam and to said center beam, said seat having an upwardly extending backrest;

a drive assembly being detachably attached to said center beam between said front and back crossbeams;

said drive assembly having a post detachably attached to said front crossbeam, a first end of said post having a drive wheel rotatably mounted thereto, said drive wheel having a pair of foot pedals extending therefrom, a second end of said post having said rotatable driven wheel detachably attached thereto, said drive assembly having an endless loop looped around said drive wheel and said driven wheel;

said rear rudder having a forwardly extending tiller detachably coupled thereto;

an upwardly extending elongate mast being detachably and swivelably attached to said center beam between said front and back crossbeams;

an umbrella sail being forwardly extended from an upper end of said mast, said umbrella sail having an elongate shaft coupled at a first end of said shaft to said upper end of said mast and a canopy coupled to a second end of said shaft opposite said first end of said shaft;

said shaft of said umbrella sail being extended generally horizontally;

a guide handle being rearwardly extended from said upper end of said mast, said guide handle having a pair of elongate portions pivotally coupled together, a first of said elongate portions of said guide handle being positioned adjacent said upper end of said mast and being extended substantially parallel to said shaft of said umbrella sail, a second of said elongate portions of said guide handle terminating at a handgrip; and a keel being detachably attached to said center beam, said keel comprising a mounting bracket detachably attaching said keel to said center beam and an elongate center board slidably extended through said mounting bracket and downwardly depending from said center beam.

13. A floatation device system, comprising:

a spaced apart pair of pontoons having opposite front and back ends, and a longitudinal axis extending between said front and back ends of the respective pontoon;

spaced apart elongate front and back crossbeams being extended between said pontoons, said crossbeams each having a pair of ends and a longitudinal axis extending between said ends of the respective crossbeam;

said front crossbeam being positioned towards said front ends of said pontoons, said back crossbeam being positioned towards said back ends of said pontoons;

an elongate center beam having opposite forwards and rearwards ends and a longitudinal axis being extended between said forwards and rearwards ends of said center beam;

said forwards end of said center beam being coupled to front crossbeam, said center beam being coupled to said back crossbeam;

said rearwards end of said center beam being rearwardly extended from said back crossbeam, said rearwards end of said center beam being positioned between said back crossbeam and said back ends of said pontoons;

a rear rudder having upper and lower ends, said upper end of said rear rudder being pivotally coupled to said rearwards end of said center beam;

a rotatable propeller being mounted to said rear rudder;

a rotatable driven wheel;

an elongate flexible sheathed cable connecting said driven wheel to said propeller, said driven wheel rotating said cable when said driven wheel is rotated, said cable rotating said propeller when said cable is rotated;

an upwardly extending elongate mast being detachably and swivelably attached to said center beam between said front and back crossbeams, an umbrella sail being forwardly extended from an upper end of said mast, said umbrella sail having an elongate shaft coupled at a first end of said shaft to said upper end of said mast and a canopy coupled to a second end of said shaft opposite said first end of said shaft.

14. The floatation device system of claim 13, wherein said shaft of said umbrella sail is extended generally horizontally.

15. The floatation device system of claim 13, further comprising a guide handle being rearwardly extended from said upper end of said mast, said guide handle having a pair of elongate portions pivotally coupled together, a first of said elongate portions of said guide handle being positioned adjacent said upper end of said mast and being extended substantially parallel to said shaft of said umbrella sail, a second of said elongate portions of said guide handle terminating at a handgrip.

16. The floatation device system of claim 13, further comprising a keel being detachably attached to said center beam, said keel comprising a mounting bracket detachably attaching said keel to said center beam and an elongate center board slidably extended through said mounting bracket and downwardly depending from said center beam.

17. A floatation device system, comprising:

a spaced apart pair of pontoons having opposite front and back ends, and a longitudinal axis extending between said front and back ends of the respective pontoon;

spaced apart elongate front and back crossbeams being extended between said pontoons, said crossbeams each having a pair of ends and a longitudinal axis extending between said ends of the respective crossbeam;

said front crossbeam being positioned towards said front ends of said pontoons, said back crossbeam being positioned towards said back ends of said pontoons;

an elongate center beam having opposite forwards and rearwards ends and a longitudinal axis being extended between said forwards and rearwards ends of said center beam;

said forwards end of said center beam being coupled to front crossbeam, said center beam being coupled to said back crossbeam;

said rearwards end of said center beam being rearwardly extended from said back crossbeam, said rearwards end of said center beam being positioned between said back crossbeam and said back ends of said pontoons;

a rear rudder having upper and lower ends, said upper end of said rear rudder being pivotally coupled to said rearwards end of said center beam;

a rotatable propeller being mounted to said rear rudder;

a rotatable driven wheel;

an elongate flexible sheathed cable connecting said driven wheel to said propeller, said driven wheel rotating said cable when said driven wheel is rotated, said cable rotating said propeller when said cable is rotated;

a seat being detachably attached to said back crossbeam and to said center beam, said seat having an upwardly extending backrest; and a drive assembly being detachably attached to said center beam between said front and back crossbeams, said drive assembly having a post detachably attached to said front crossbeam, a first end of said post having a drive wheel rotatably mounted thereto, said drive wheel having a pair of foot pedals extending therefrom, a second end of said post having said rotatable driven wheel detachably attached thereto, said drive assembly having an endless loop looped around said drive wheel and said driven wheel.

18. The floatation device system of claim 17, wherein said rear rudder has a forwardly extending tiller detachably coupled thereto.

* * * * *